US006941900B1

(12) United States Patent
Malinov

(10) Patent No.: US 6,941,900 B1
(45) Date of Patent: Sep. 13, 2005

(54) VAL ROTARY ENGINE

(76) Inventor: Valentin Malinov, 16 Curlew Close, Melton, Victoria -3337 (AU)

( * ) Notice: Subject to any disclaimer, the term of this patent is extended or adjusted under 35 U.S.C. 154(b) by 0 days.

(21) Appl. No.: 10/797,622

(22) Filed: Mar. 10, 2004

(51) Int. Cl.[7] ..... F02B 33/00; F01C 3/00

(52) U.S. Cl. ..... 123/18 R; 123/241; 418/68; 418/195; 418/215; 418/49

(58) Field of Search ..... 123/18 R; 418/241, 418/68, 195, 215, 49

(56) References Cited

U.S. PATENT DOCUMENTS

| | | | | | |
|---|---|---|---|---|---|
| 168,034 | A | * | 9/1875 | Lyon | 418/68 |
| 389,927 | A | * | 9/1888 | Hurdle et al. | 418/68 |
| 1,150,430 | A | * | 8/1915 | Hamann | 418/68 |
| 1,890,612 | A | * | 12/1932 | Kempthorne | 418/68 |
| 2,708,413 | A | * | 5/1955 | Loewen | 418/68 |
| 3,156,222 | A | * | 11/1964 | Miller, Jr. | 123/241 |
| 3,816,039 | A | * | 6/1974 | Berry | 418/68 |
| 3,877,850 | A | * | 4/1975 | Berry | 418/68 |
| 5,127,810 | A | * | 7/1992 | Kolbinger | 418/68 |
| 5,336,067 | A | * | 8/1994 | Lim | 123/241 |

FOREIGN PATENT DOCUMENTS

| | | | | | |
|---|---|---|---|---|---|
| DE | 3404172 | A1 | * | 8/1985 | 418/195 |
| DE | 4325166 | A1 | * | 2/1995 | 418/68 |
| FR | 2321584 | A | * | 4/1977 | 123/18 R |
| GB | 2052639 | A | * | 1/1981 | 418/195 |
| JP | 56009691 | A | * | 1/1981 | 418/68 |

* cited by examiner

*Primary Examiner*—Thai-Ba Trieu
(74) *Attorney, Agent, or Firm*—Michael J. Foycik, Jr.

(57) ABSTRACT

A rotary engine has a spherical enclosure serving as a combustion chamber, a first baffle inside the combustion chamber slideable along a groove formed in the spherical enclosure, and a second baffle disposed in the combustion chamber which is in sealing engagement with the internal spherical surface of the combustion chamber. The second baffle is carried by a rotatable shaft, the shaft extending into the spherical combustion chamber. The first baffle rests against the second baffle, and separates the interior of the combustion chamber into a first part and a second part. A first valve in a first opening is disposed to communicate with the first part of the combustion chamber, and a second valve in a second opening is disposed to communicate with the second part of the combustion chamber.

9 Claims, 13 Drawing Sheets

D

VAL ROTARY ENGINE

FIELD OF THE INVENTION

The present invention relates to a rotary internal combustion engine.

BACKGROUND OF THE INVENTION

Internal combustion engines are known in the art. Further, rotary internal combustion engines are known in the art.

There are disadvantages of the existing rotary internal combustion engines as compared with existing four stroke piston engines. For example, rotary internal combustion engines can not match the reliability of piston engines. Problems of existing rotary internal combustion engines may include poor lubrication, overheating, excessive friction between the rotor and cylinder, and insufficient number of cycles.

Although well known for its reliability, there are well known disadvantages of existing four stroke piston internal combustion engines. For example, major disadvantages of piston engines include the necessity to accelerate and stop the piston and the connection rod four times in each single working cycle for a cylinder. This represents a significant loss of energy, and results in a significant loss of efficiency.

Another disadvantage of the piston engine is the centrifugal force, which the connecting rod applies against the piston side when the piston slides up and down in the cylinder. This creates wear, friction, heat, and thereby causes a loss of energy as well. Also, the direction of movement of the connection rod is not in the same direction as that of the piston, creating an additional side force between the piston and the cylinder, with resultant friction and loss of energy. Further, a massive crank shaft is needed for conventional piston engines, to transfer the linear movement of the piston into a rotational output.

It is a problem in the internal combustion engine art to reduce or eliminate the aforementioned problems and their effects. It is also a problem in the internal combustion engine art to combine the advantages of the rotary and piston engines.

SUMMARY OF THE INVENTION

From the foregoing, it is seen that it is a problem in the art to provide a device meeting the above requirements. According to the present invention, a device and process are provided which meets the aforementioned requirements and needs in the prior art.

More particularly, the present invention relates to a VAL rotary engine having advantages of both rotary and piston engines. The rotary engine of the present invention also advantageously has a compact design.

According to the present invention, a spherical enclosure is provided to serve as the combustion chamber. A first baffle is disposed inside the combustion chamber and is slideable along a groove formed in the combustion chamber. A second baffle is disposed in the combustion chamber, which is in sealing engagement with the internal spherical surface of the combustion chamber. The second baffle is carried by a rotatable shaft, the shaft extending into the spherical combustion chamber. The first baffle rests against the second baffle, and separates the interior of the combustion chamber into a first part and a second part. Two valves in a first opening are disposed to communicate with the first part of the combustion chamber, and two valves in a second opening are disposed to communicate with the second part of the combustion chamber.

In the present invention, combustion occurring consequently in both chambers results in a force acting upon the first and second baffles. This force results in pushing down the second baffle and the rotatable shaft connected thereto. The opening and closing of the first and second valves of each chamber is accomplished by a timing mechanism, such as a cam, to perform the steps of intake, compression, ignition, and exhaust.

The present invention has among its advantages that the rotor has no friction with the spherical chamber within which it operates, and that the parts which form the burning chamber are not rotating but rather swing about the center and have excellent air tight sealing and lubrication without a pressing force between the moving parts and the spherical chamber. This results in less friction, less heat, and less resistance and more power for the same amount of fuel, plus a longer life of the engine.

The bottom part of the spherical chamber according to the present invention is used like an oil pen for internal cooling and splash lubrication.

Further, with the present invention, because the engine is very compact and the distance between the main shaft and the valves is small, it is advantageously possible to open the valves in a simple way by using a shaft driving cam sleeve with two cams only, one for each working chamber. The cams serve to push up the lifting rods which actuate the valves. The expansion of the lifting rods will be compensated with the hydraulic compensator, that is, the lifting rods can be positioned in the exact necessary locations around the cam sleeve.

As a result of the foregoing, the VAL rotary engine has the following qualities.

1. Because the two chambers are working on an opposite phase, they use little space which allows the engine to be extremely compact as compared with the prior art rotary and piston engines. For example, a sphere with a diameter of 20 cm. can house up to a 2600 cc engine, or a 15 cm. Sphere (the size of a grapefruit) will be about 1000 cc.

2. There is excellent lubrication by the splashing and the oil pump.

3. There is very little friction, and little friction under pressure, because the main parts are supported in the bearings and the groove where there is good lubrication and not burning gases.

4. The cooling is like that in piston engines, external with a water jacket and internal with the oil inside.

5. Less friction, which means less waste heat generation, better efficiency, and better reliability as compared with the prior art piston engines.

6. Ease of production, with two or more times fewer parts as compared with conventional existing piston engines.

When the rotor of the VAL rotary engine is rotating, the baffles are forced to move as well. Because the baffles are connected in the center of the sphere, and the first baffle can move only in the direction of the groove in the sphere, the movement of the baffles is limited. Thus the first baffle can move only in the direction of the groove, while the second baffle must follow the rotor and lift and lower its two sides around the connecting point. These movements create expansion and contraction of the two chambers, which is the requirement for an internal combustion engine. Accordingly, the VAL rotary engine has the same cycle as that of an internal combustion engine, namely four strokes per two rotations (each chamber).

The spherical chamber can cooled either by a water jacket or by air cooling.

Other objects and advantages of the present invention will be more readily apparent from the following detailed description when read in conjunction with the accompanying drawings.

BRIEF DESCRIPTION OF THE DRAWINGS

FIGS. 3-1 to 3-4 are schematic representations of the combustion process for a single chamber of the invention of FIG. 1.

DETAILED DESCRIPTION OF THE INVENTION

Figure 1:
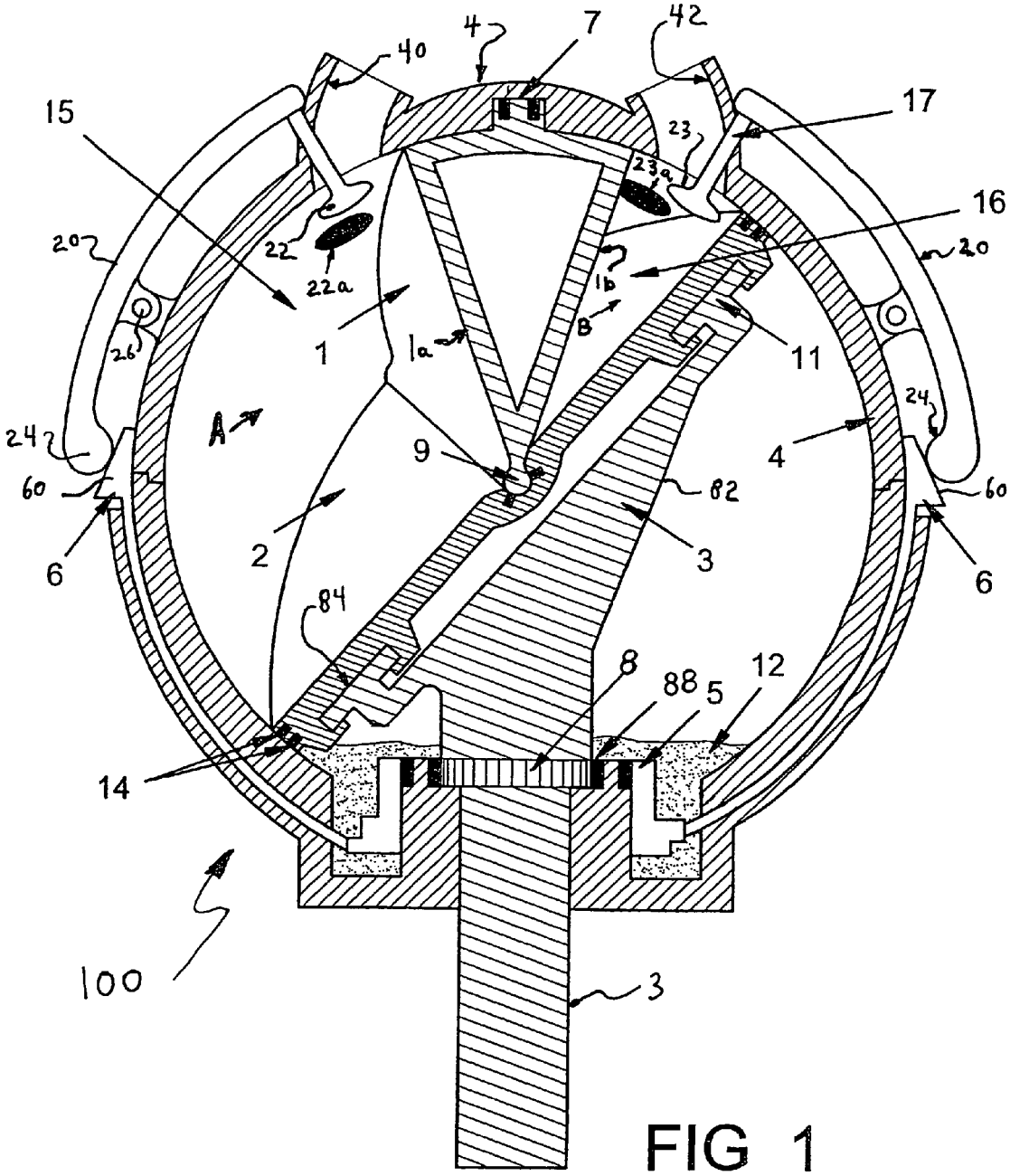
FIG. 1 is a schematic, side sectional view of the VAL rotary engine according to the present invention.

FIG. 1 shows a schematic, side sectional view of a rotary engine 100 according to the present invention. The rotary engine 100 includes a spherical member 4 housing a first baffle member 1 and a second baffle member 2. The spherical member 4 also houses a rotor 3 which is connected to a shaft extending beyond the spherical member 4. The spherical member 4 has four ports, two in each chamber. As viewed in FIG. 1, there is four ports 17 which include openings 40, 42, 22*a*, and 23*a*. Such ports are conventional in internal combustions engines and no further description is necessary inasmuch as the skilled artisan will understand how to place and operate such ports. The valves 22 and 23 are respectively disposed so as to open and close openings 22*a* and 23*a*.

The first baffle member 1 and the second baffle member 2 together divide the interior of the spherical member 4 into a first combustion chamber 15 and a second combustion chamber 16, as seen in FIG. 1. The first baffle member 1 and the second baffle member 2 are discussed further herunder.

A lubricant pool 12 is disposed at the lower end of the rotor 3. The lubricant may be any lubricant suitable for use in a rotary combustion engine, such as oil.

A large gear 8 is disposed at the base of the rotor 3 and engages smaller gears 88. The small gears 88 drive a cam sleeve 5 which in turn is connected to lifting rods 6 having enlarged valve lift portions 60 at distal portions thereof. Four valve lifters 20 are mounted on opposite sides of the spherical member 4, and each valve lifter 20 has a cam engaging portion 24, a pivot 26, and a valve 22. The lifting rods are spring forced back.

As shown in FIG. 1, the first baffle member 1 is shown in section, and has a hollow interior. The interior may also be solid, or may have a partially hollowed or honeycombed structure, or may include coolant ducts or the like; all such variations are within the ambit of one having skill in the rotary engine arts and in the piston engine arts. The first baffle member 1 engages with the second baffle member 2 at a connecting groove 9 formed in the second baffle member 2. The second baffle member 2 has a circular face with a diameter substantially equal to the interior diameter of the spherical member 4, with only a very slight clearance to enable relative movement between the second baffle member 2 and the spherical member 4. The clearance is sufficiently small, however, and baffle rings can be provided to substantially prevent leakage of gasses between the second baffle member 2 and the spherical member 4. Lubrication by splashing may be provided to facilitate sliding between the outermost edges of the second baffle member 2 and the interior surface of the spherical member 4.

The second baffle member 2 includes an annularly shaped groove 11 about its lower periphery. The rotor 3 includes an upper portion 82 and an annularly shaped portion 84 sized to be received within the annularly shaped groove 11. There is sufficient clearance between the annularly shaped groove 11 and the annularly shaped portion 84 to permit rotational sliding movement therebetween when the rotor 3 rotates. Lubrication will be provided to facilitate sliding between the annularly shaped portion 84 and the annularly shaped groove 11.

The first baffle member 1 engages a groove 7 formed in the wall of the spherical member 4, so that the first baffle member 1 is confined to a reciprocating movement along the groove 7. The second baffle member 2 is prevented from rotating with the rotation of the rotor 3 because the connecting groove 9 of the second baffle member 2 is pivotally connected to the lowermost end of the first baffle member 1 opposite the groove 7. Thus, the first baffle member 1 must follow the oscillatory movement of the second baffle member 2.

The first baffle member 1 has two opposed faces 1*a* and 1*b* as seen in FIG. 1. Each of the faces 1*a* and 1*b* is formed as a substantially half circle with a diameter substantially equal to the interior diameter of the spherical member 4, with only a very slight clearance to enable relative movement between the first baffle member 1 and the spherical member 4. On the sphere side are the baffle rings (see FIG. 11) which is in correspondence with the piston rings of a conventional piston engine, sealing the chamber. The clearance is sufficiently small, so that together with two sealing half rings on each side to substantially prevent leakage of gasses between the first baffle member 1 and the spherical member 4. Lubrication cooling may be provided to facilitate sliding between the outermost edges of the first baffle member 1 and the interior surface of the spherical member 4 and the connecting groove 9. The oil will come from groove 7 through the walls of baffle 1 and go out through groove 9 and baffle 2.

The lubrication referred to hereinabove with respect to several of the moving parts may be provided simply by splash lubrication of the lubricant in the pool 12, or can be directly applied by any known lubricant applying means known in the internal combustion engine arts, including sprayed lubrication, grooves and/or ducts conducting lubricant to the intended areas, a lubricant pump, among other types of known lubricating means.

The parts composing the rotary engine 100 may be composed of materials suitable to the fuel being burned. The spherical member 4, the first baffle member 1, and the second baffle member 2 are preferably, for example, composed of a high temperature composite material using powdered metal technology, and such powdered metal composites are known in the engine fabrication arts. Alternatively, these parts may be composed of high temperature steel and/or steel alloys, and different portions thereof may have different compositions. For example, the rims of the first baffle member 1 and the second baffle member 2 may be composed of a wear-resistant material having a very low coefficient of friction, and such materials are know in the engine fabrication arts. For combustion of a low temperature fuel, such as those that combust at temperatures only a little above room temperature, the parts could instead be composed of aluminum or a high temperature plastic material. Such low temperature fuels are known for use in laboratories and for special effects in movies, and may also for example be produced from various natural processes or in various types of recycling of waste products.

The present invention has among its advantages that the rotor has no friction with the spherical chamber within which it operates, and that the parts which form the burning chamber are not rotating but rather swing about the center and have excellent air tight sealing and lubrication without a pressing force between the moving parts and the spherical chamber. This results in less friction, less heat, and less resistance and more power for the same amount of fuel, plus a longer life of the engine.

The bottom part of the spherical chamber according to the present invention is used like an oil pen for internal cooling and splash lubrication.

Further, with the present invention, because the engine is very compact and the distance between the main shaft and the valves is small, it is advantageously possible to open the valves in a simple way by using a shaft driving cam sleeve with two cams only, one for each working chamber. The cams serve to push up the lifting rods which actuate the valves. The expansion of the lifting rods will be compensated with the hydraulic compensator, that is, the lifting rods can be positioned in the exact necessary locations around the cam sleeve. As a result of the foregoing, the VAL rotary engine has the following qualities.

1. Because the two chambers are working on an opposite phase, they use little space which allows the engine to be extremely compact as compared with the prior art rotary and piston engines. For example, a sphere with a diameter of 20 cm. can house up to a 2600 cc engine, or a 15 cm. Sphere (the size of a grapefruit) will be about 1000 cc.

2. There is excellent lubrication by the splashing and the oil pump.

3. There is very little friction, and little friction under pressure, because the main parts are supported in the bearings and the groove where there is good lubrication and not burning gases.

4. The cooling is like that in piston engines, external with a water jacket and internal with the oil inside.

5. Less friction, which means less waste heat generation, better efficiency, and better reliability as compared with the prior art piston engines.

6. Ease of production, with two or more times fewer parts as compared with conventional existing piston engines.

When the rotor of the VAL rotary engine is rotating, the baffles are forced to move as well. Because the baffles are connected in the center of the sphere, and the first baffle can move only in the direction of the groove in the sphere, the movement of the baffles is limited. Thus the first baffle can move only in the direction of the groove, while the second baffle must follow the rotor and lift and lower its two sides around the connecting point. These movements create expansion and contraction of the two chambers, which is the requirement for an internal combustion engine. Accordingly, the VAL rotary engine has the same cycle as that of an internal combustion engine, namely four strokes per two rotations (each chamber).

The spherical chamber can cooled either by a water jacket or by air cooling.

Figure 2A:
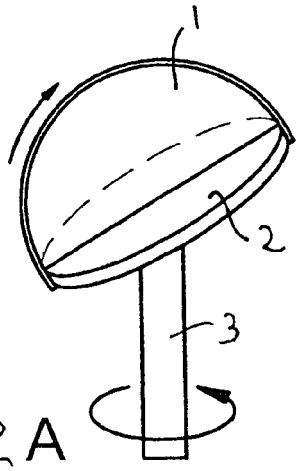
FIGS. 2A–2D are schematic representations of various positions of first and second baffles used in the invention of FIG. 1 during rotational shaft movement.
Figure 2B:
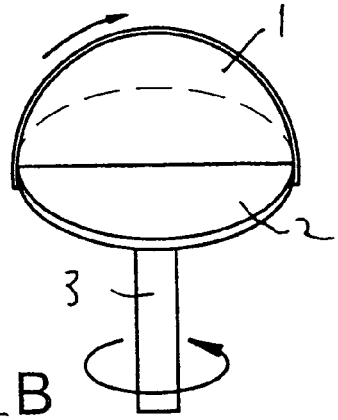
Figure 2C:
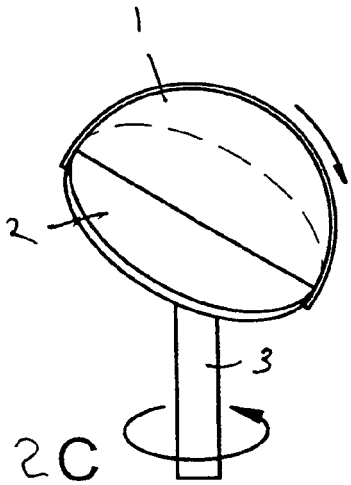
Figure 2D:
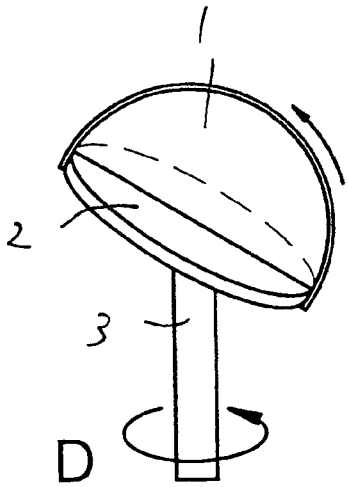

FIGS. 2A–2D are schematic representations of various positions of the first baffle member 1 and the second baffle member 2 in the device of FIG. 1 during rotational shaft movement of the rotor 3. In FIG. 2A, the direction of rotation of the rotor 3 as viewed from above is anti-clockwise, and the first baffle member 1 is urged in a direction upwardly and toward the right as indicated by the arrow in this figure. In FIG. 2B, the second baffle member 2 has been tilted toward the right and downward as compared with FIG. 2A, and the first baffle member 1 is urged directly toward the right as indicated by the arrow in FIG. 2B. In FIG. 2C, the second baffle member 2 has been tilted even more toward the right as compared with FIG. 2B, and the first baffle member 1 is urged downwardly and toward the right as indicated by the arrow in FIG. 2C. In FIG. 2D, the right side of the second baffle member 2 is at its rightward-most position and shortly will be urged upwardly and leftwardly. Also in FIG. 2D, the first baffle member 1 is at its rightmost position and is now being urged upwardly and toward the left as indicated by the arrow in FIG. 2D.

Figures 1, 3:
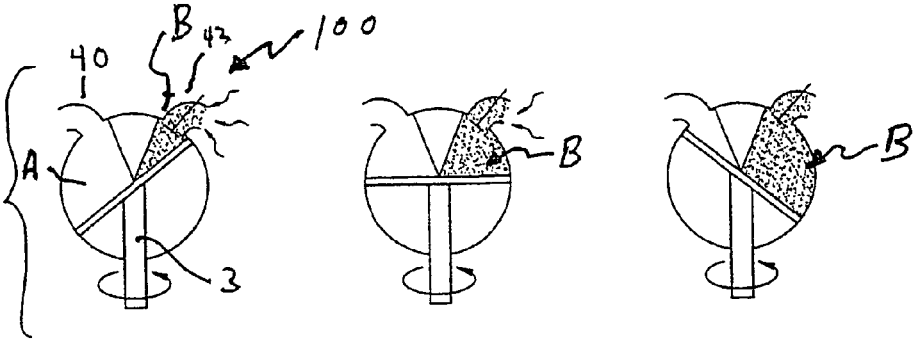
Figures 2, 3:
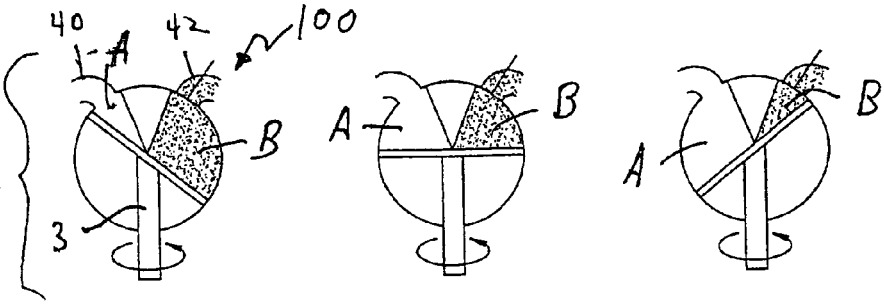
Figure 3:
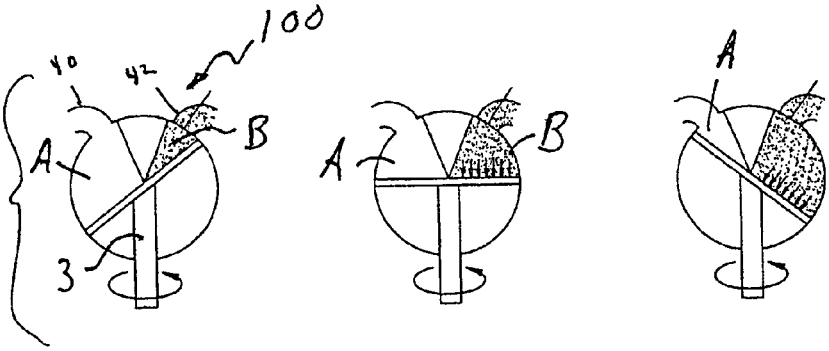
Figures 3, 4:
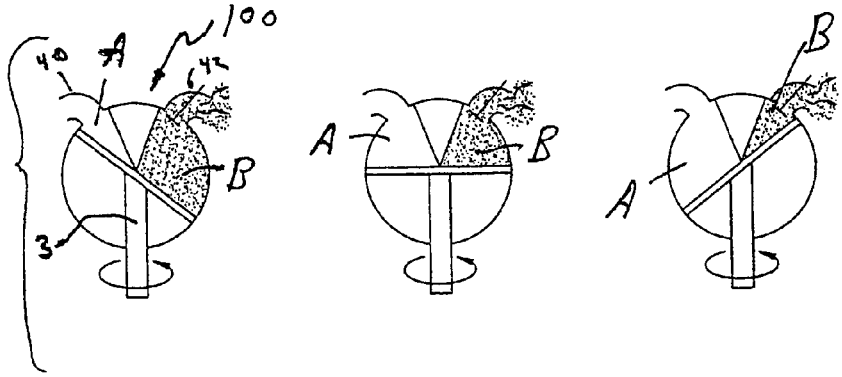

FIGS. 3-1 to 3-4 are schematic representations of the combustion process for a single chamber B of the rotary engine 100 of FIG. 1. Specifically, FIG. 3-1 depicts three consecutive steps during an intake stroke of the rotary engine 100. As seen in the first step in FIG. 3-1, an air-fuel mixture is taken in through the port 42 as the chamber B begins to expand during rotation of the rotor 3. In the next step of FIG. 3-1, the intake continues and the chamber B is enlarged about halfway. In the final step of FIG. 3-1, the chamber B is at its maximum size, and the intake step has been completed.

FIG. 3-2 depicts three consecutive steps during a compression stroke of the rotary engine 100. As seen in the first step in FIG. 3-2, the air-fuel mixture in chamber B has been taken in through the port 42 and the port 42 is then closed, as compression is about to begin during further rotation of the rotor 3. In the next step of FIG. 3-2, the compression step continues and the chamber B is compressed about halfway between its maximum and minimum volumes. In the final step of FIG. 3-2, the chamber B is at its minimum size, and compression has been completed.

FIG. 3-3 depicts three consecutive steps during the ignition (working) stroke of the rotary engine 100. During these steps, the valve 42 remains closed. As seen in the first step in FIG. 3-3, the chamber B is at its minimum size and the air-fuel mixture in chamber B is ignited so that combustion begins. In the next step of FIG. 3-3, the combustion step continues and the mixture in the chamber B has become heated and exerts pressure (indicated by the small arrows) against the second baffle member 2 and thence upon the rotor 3 causing a torque to be applied in the direction of rotation thereof. In this second step of FIG. 3-3, the expansion of chamber B is about halfway between its maximum and minimum volumes. In the final step of FIG. 3-3, the chamber B is almost at its maximum size, and expansion has been substantially completed.

FIG. 3-4 depicts three consecutive steps during the exhaust stroke of the rotary engine 100. During these steps, the exhaust valve is opened to permit exhaust of the combustion products. As seen in the first step in FIG. 3-4, the chamber B is at its maximum size and the combustion products begin to leave the chamber B. In the next step of FIG. 3-4, the chamber B has contracted in volume due to continued rotation of the rotor 3 and the combustion products are vented out of the chamber B through the open exhaust valve. In this second step of FIG. 3-4, the contraction of chamber B is about halfway between its maximum and minimum volumes. In the final step of FIG. 3-4, the chamber B is almost at its minimum size, and the exhaust step has been substantially completed.

It is noted that FIGS. 3-1 through 3-4 depict only one of the two chambers in operation, namely chamber B, and this has been done for the sake of clarity. However, during all these steps, chamber A is also being used. The steps for chamber A in FIGS. 3-1 through 3-4 are opposite to those for chamber B, i.e. in FIG. 3-1 the chamber A is performs its own compression exhaust step, in FIG. 3-2 the chamber A performs its own ignition step, in FIG. 3-3 the chamber A performs its own exhaust step, and in FIG. 3-4 the chamber A performs its own intake step.

Figure 4A:
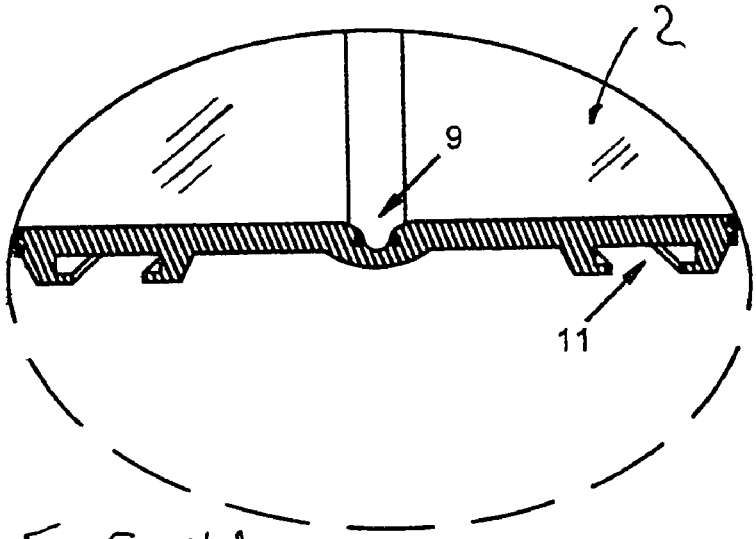
FIG. 4A is a perspective view, partially in section, with the broken away portion shown in phantom outline, of a second baffle shown in FIG. 1 for applying pressure to the rotor.

FIG. 4A is a perspective view, partially in section, with the broken away portion shown in phantom outline, of the second baffle 2 of FIG. 1, which during the working steps applies pressure to the rotor 3. In this view, the groove 9 is shown as a recess in the disk-like surface of the second baffle member 2, but in an alternative embodiment the groove 9 can be much deeper so as to pivotably retain the baffle 1 therein. The cross-sectional shape of the annularly shaped groove 11 of the second baffle member 2 is clearly shown in FIG. 4A.

Figure 4B:
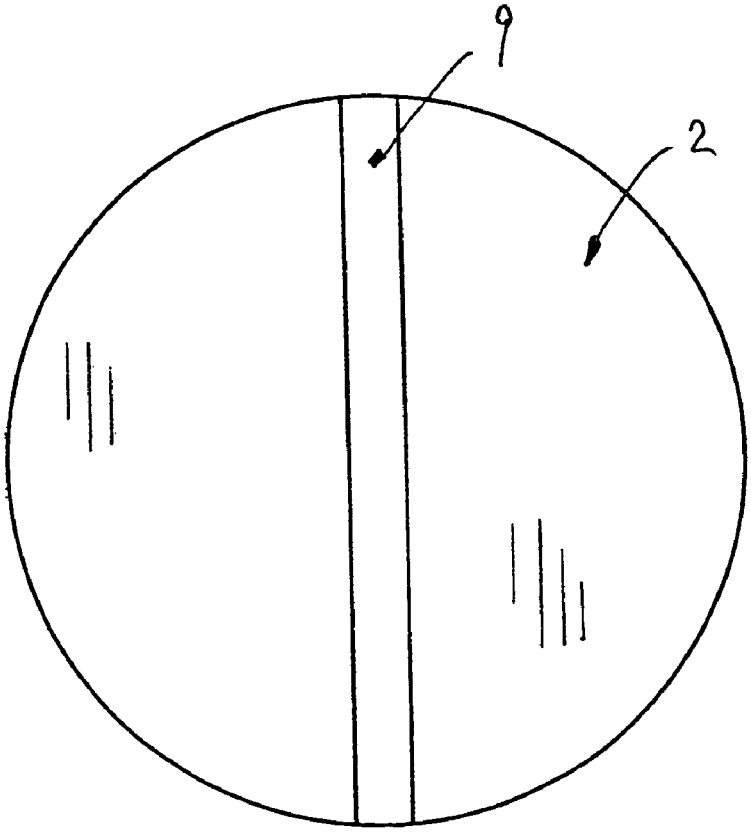
FIG. 4B is a top elevational view of the baffle of FIG. 4A.

FIG. 4B is a top elevational view of the second baffle member 2 of FIG. 4A. In this view, the circular shape of the second baffle member 2 is clearly seen, as is the shape of the groove 9 therein.

Figure 5A:
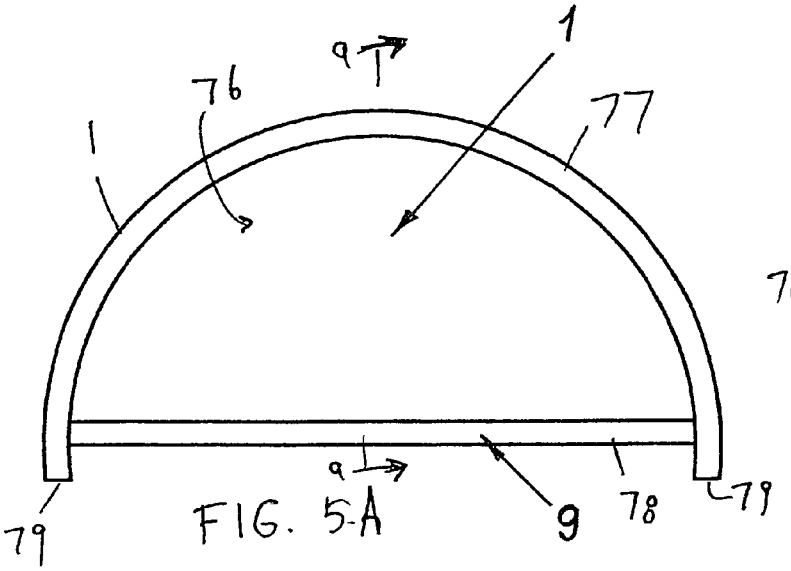
FIG. 5A is a front elevational view of a first baffle which is slideable in the invention of FIG. 1.

FIG. 5A is a front elevational view of the first baffle member 1 which is slideable along the groove 7 of the spherical member 4 in the rotary engine 100 shown in FIG. 1. In this view, the first baffle member 1 has a semi-circular shape so that it fits closely within the interior portion of the spherical member 4, making a nearly gas-tight seal therebetween. The first baffle member 1 has a face 76, a lowermost enlarged and rounded edge 78, left and right end portions 79, and a ridge 77. The ridge 77 is shaped to closely fit into the groove 7 of the spherical member 4, and to be slideable therein so as to permit movement of the first baffle member 1 as described hereinabove.

Figure 5B:
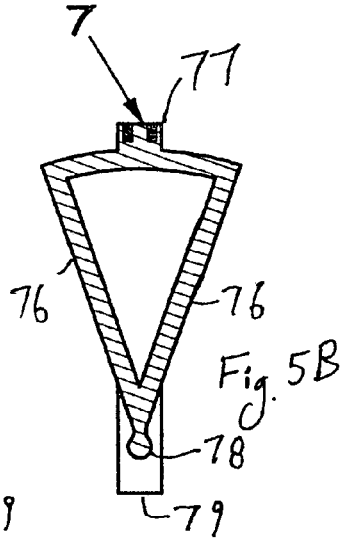
FIG. 5B is a sectional view taken along line a—a of FIG. 5A.

FIG. 5B is a sectional view taken along line a—a of FIG. 5A, showing the first baffle member 1 in section. In this view, opposite faces 76 are shown clearly, as well as the rounded shape of the edge 78.

Figure 5C:
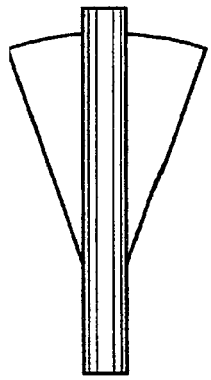
FIG. 5C is an end elevational view of the baffle of FIG. 5A as viewed from the right side thereof.

FIG. 5C is an end elevational view of the first baffle member 1 of FIG. 5A as viewed from the right side thereof. Here, the opposite faces 76 are seen, as well as the end portion 79, and the protruding ridge 77.

Figure 6A:
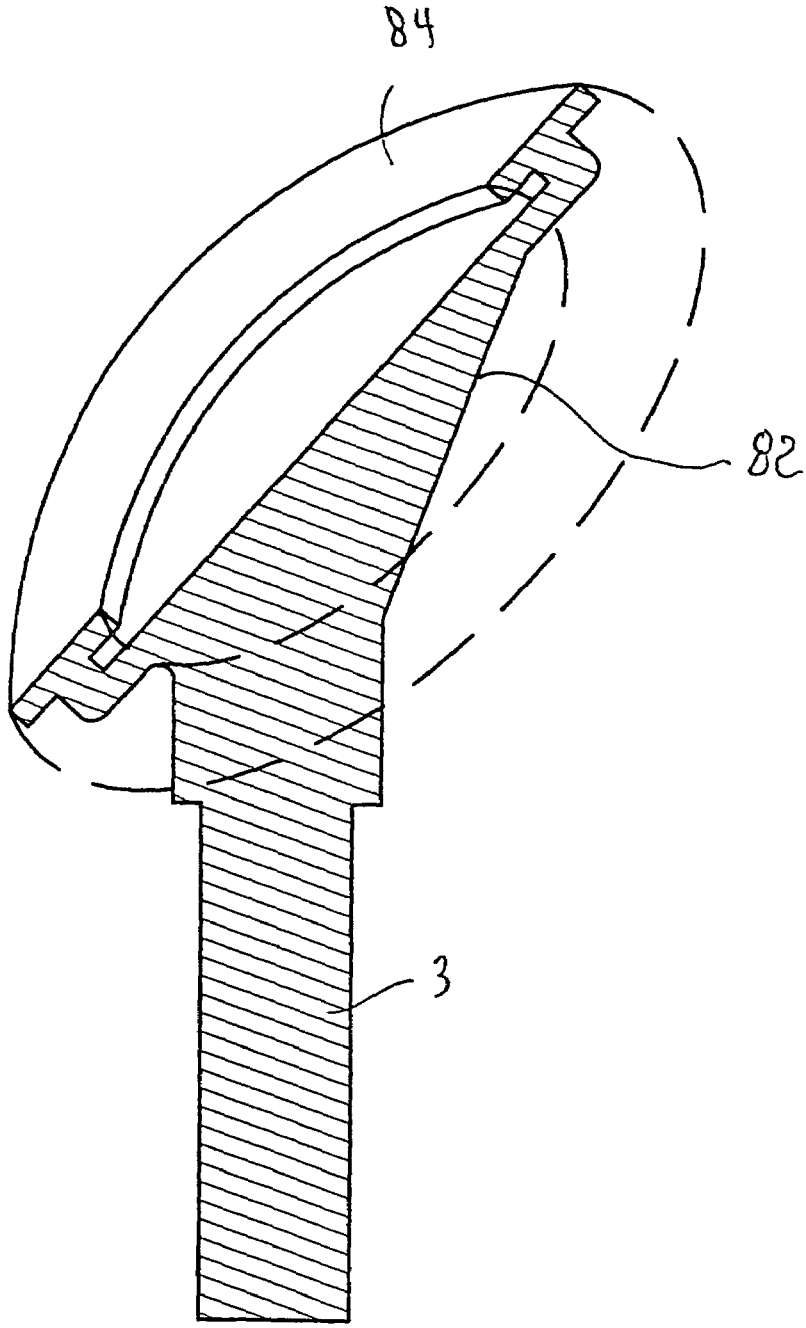
FIG. 6A is a sectional longitudinal side view of the rotor of FIG. 1.

FIG. 6A is a sectional longitudinal side view of the rotor of FIG. 1. In this view, the rotor 3 is shown having the upper portion 82 which in turn supports the annularly shaped portion 84. The annularly shaped portion 84 is sized to be received within the annularly shaped groove 11 of the second baffle member 2. There is sufficient clearance between the annularly shaped groove 11 and the annularly shaped portion 84 to permit rotational sliding movement therebetween when the rotor 3 rotates. Lubrication may be provided to facilitate sliding between the annularly shaped portion 84 and the annularly shaped groove 11. Thus, the annularly shaped portion 84 rotates, but the second baffle member 2 does not rotate and instead tilts as it follows the tilt of the angled annularly shaped portion 84 during rotation of the rotor 3.

Figure 6B:
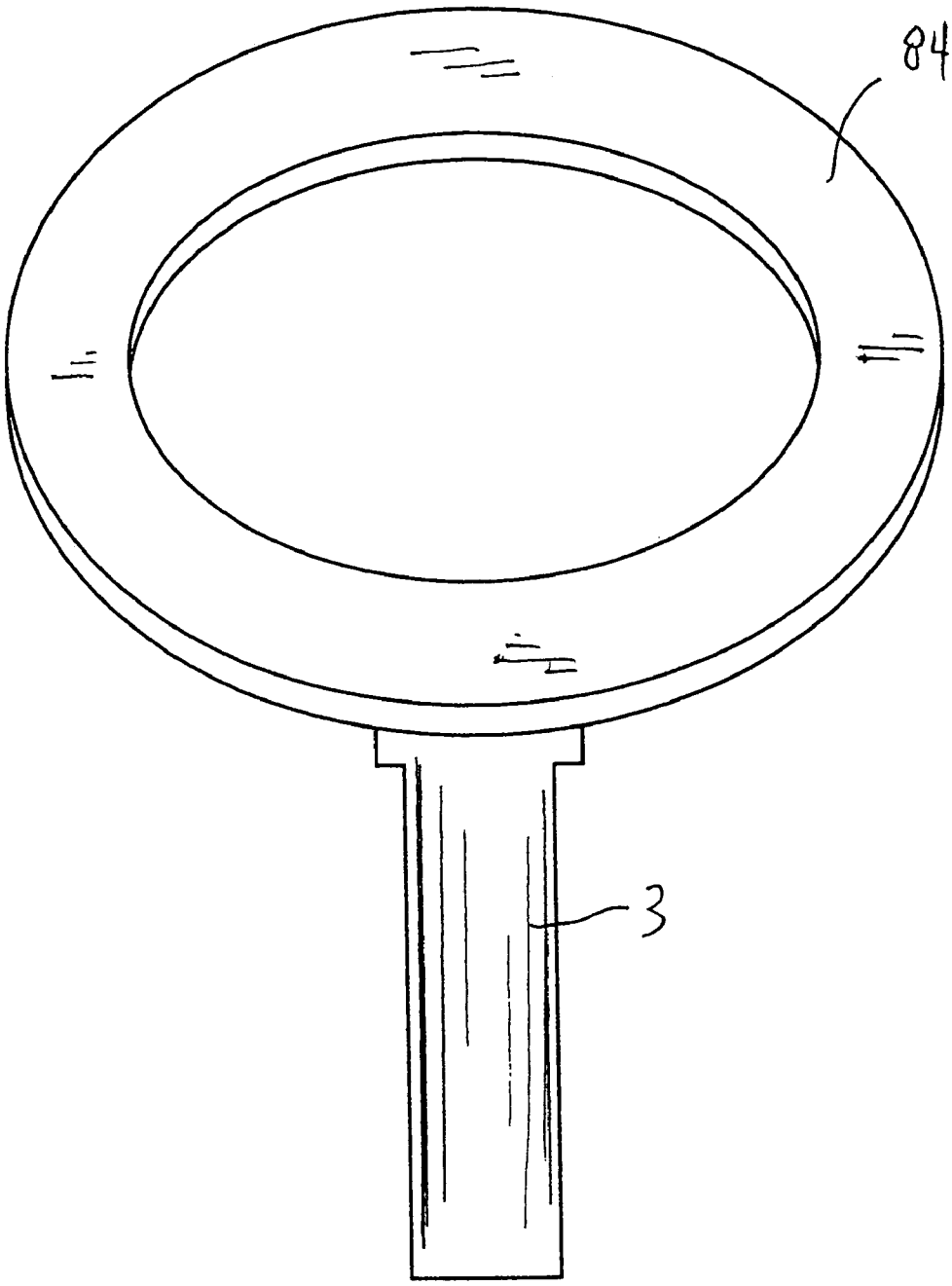
FIG. 6B is a front elevational view of the rotor of FIG. 6A.

FIG. 6B is a front elevational view of the rotor of FIG. 6A. This view shows the surface of the annularly shaped portion 84 atop the rotor 3.

Figure 7A:
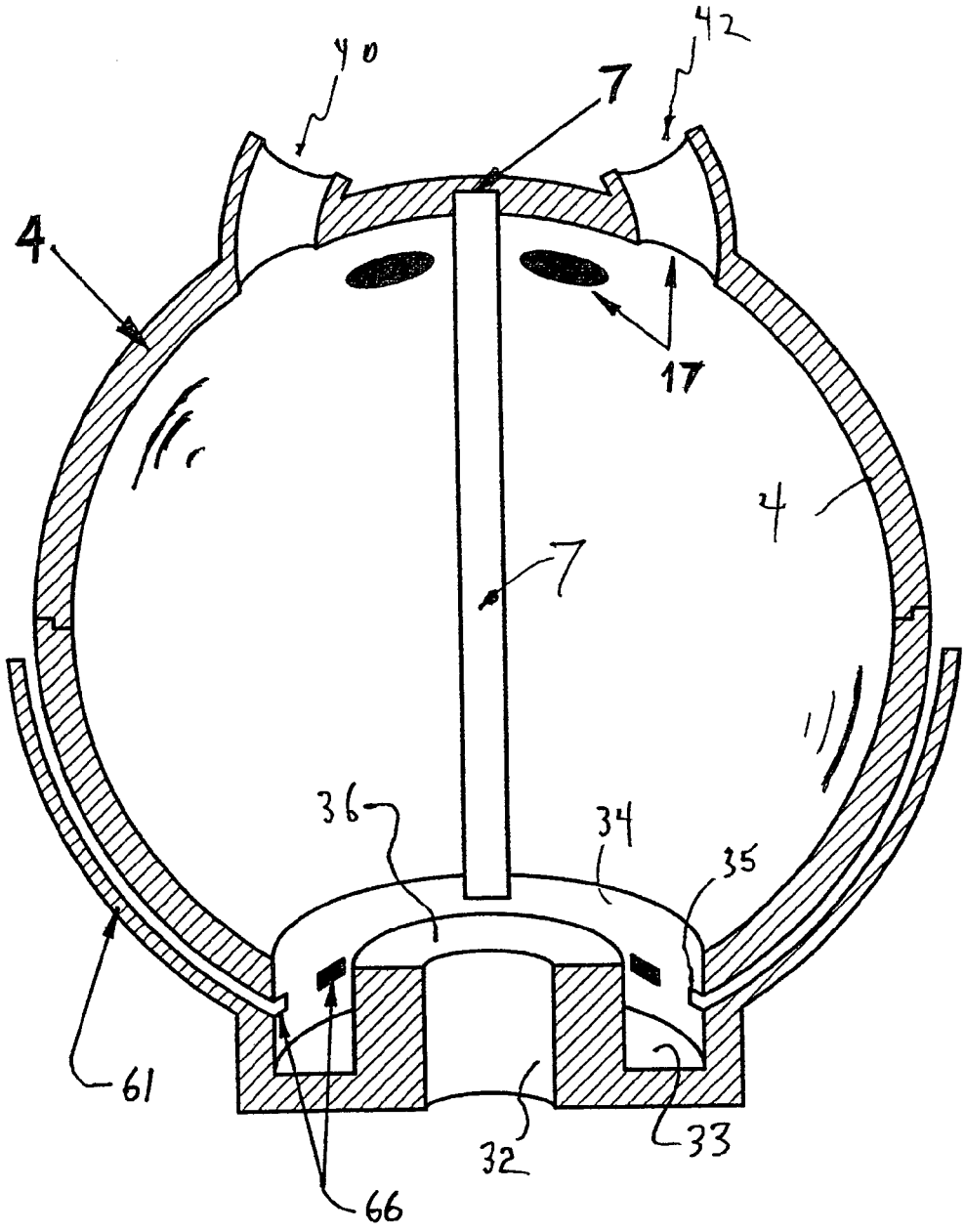
FIG. 7A is a sectional longitudinal side view of the spherical member of FIG. 1.

FIG. 7A is a sectional longitudinal side view of the spherical member 4 of the rotary engine 100 of FIG. 1. In this view, the groove 7 is clearly shown. The ports 17 and 17 are seen, as is the lowermost portion of the spherical member 4. In this lowermost portion, there are the ports 66 for the valves lifters and a collar wall 32 serving as a passageway through which the rotor 3 extends in FIG. 1, an inner spherical chamber wall 34 annularly surrounding the collar wall 32, and a bottom wall 33 which serves as a connecting wall between the collar wall 32 and the inner spherical chamber wall 34. The collar wall 32 has an upper surface 36 as seen in FIG. 7A. A pair of extending curved arms 61 are disposed on opposite sides of the inner spherical chamber wall 34, and serve to support and guide the valve lifts 6. Apertures 35 are shown disposed in the inner spherical chamber wall 34, permitting engagement of gear teeth of an inner gear member 5 (shown in FIG. 1) with gear teeth of a collar portion of the valve lifts 6 (not shown); small gears can be disposed within the apertures 35 to communicate rotational motion from the gears within the inner spherical chamber wall 34 and the valve lifts 6.

Figure 7B:
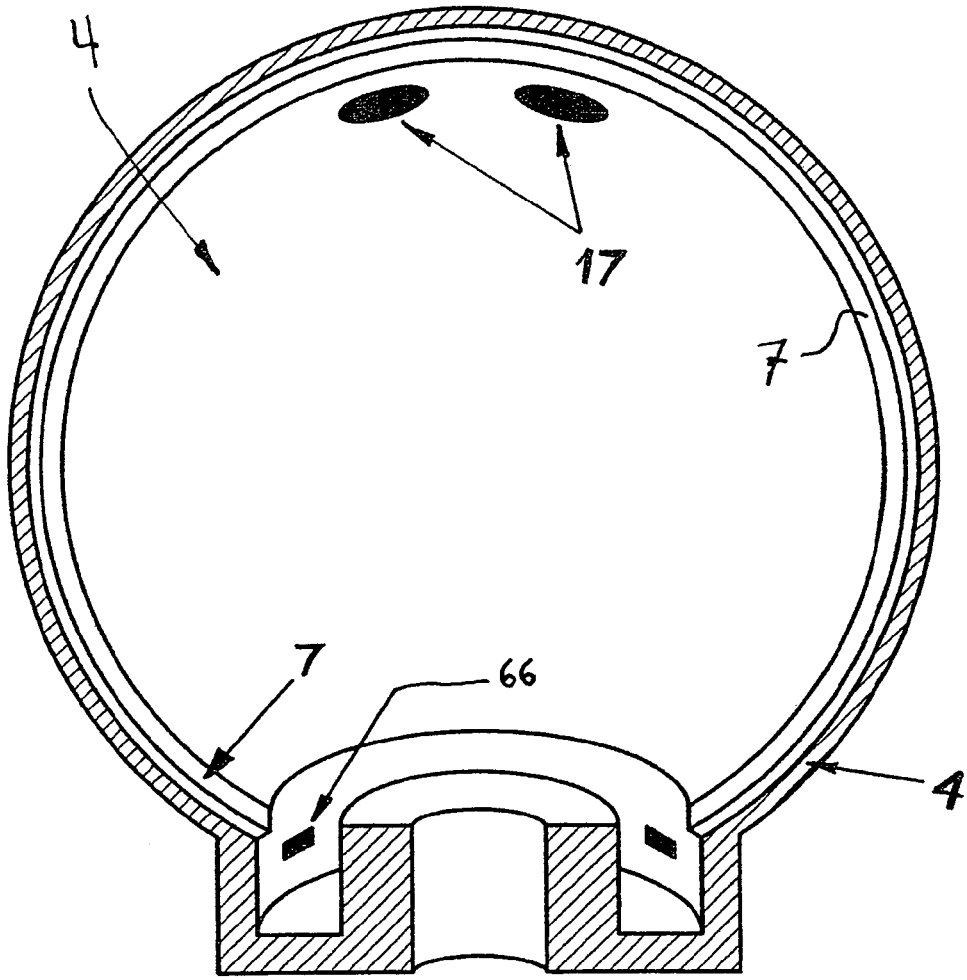
FIG. 7B is a sectional longitudinal side view taken along line b—b of FIG. 7A.

FIG. 7B is a sectional longitudinal side view of the spherical member 4 taken along line b—b of FIG. 7A. In this view, the interior side wall of the groove 7 is clearly shown, the section having been taken along the middle of the groove 7.

Figure 8A:
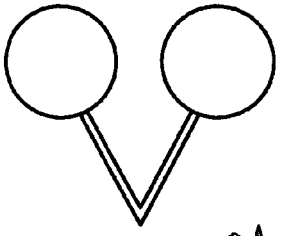
FIG. 8A is a schematic view of an arrangement of two of the rotary engines of FIG. 1 used together in a V-twin configuration.

FIG. 8A is a schematic view of an arrangement of two of the rotary engines 100 of FIG. 1 used together in a V-twin configuration.

Figure 8B:
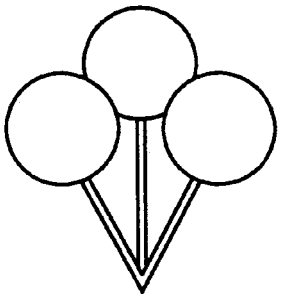
FIG. 8B is a schematic view of an arrangement of three of the rotary engines of FIG. 1 used together in a V-three configuration.

FIG. 8B is a schematic view of an arrangement of three of the rotary engines 100 of FIG. 1. In this view, the three rotary engines 100 are arranged together in a V-three configuration.

Figure 8C:
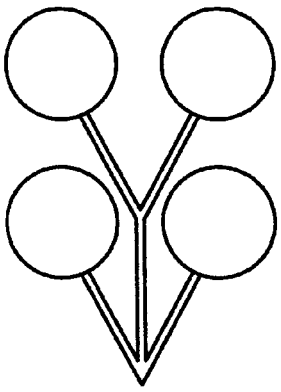
FIG. 8C is a schematic view of an arrangement of four of the rotary engines of FIG. 1 used together in a double in-line V-twin configuration.

FIG. 8C is a schematic view of an arrangement of four of the rotary engines 100 of FIG. 1 used together in a double in-line V-twin configuration.

Figure 8D:
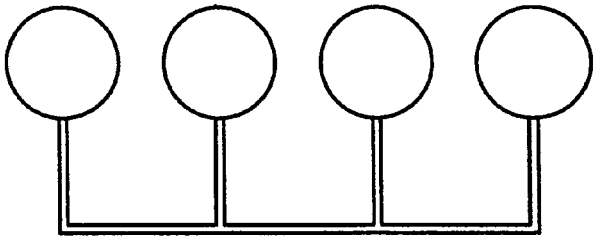
FIG. 8D is a schematic view of an arrangement of four of the rotary engines of FIG. 1 used together in a single in-line configuration.

FIG. 8D is a schematic view of an arrangement of four of the rotary engines 100 of FIG. 1 used together in a single in-line configuration.

Figure 9:
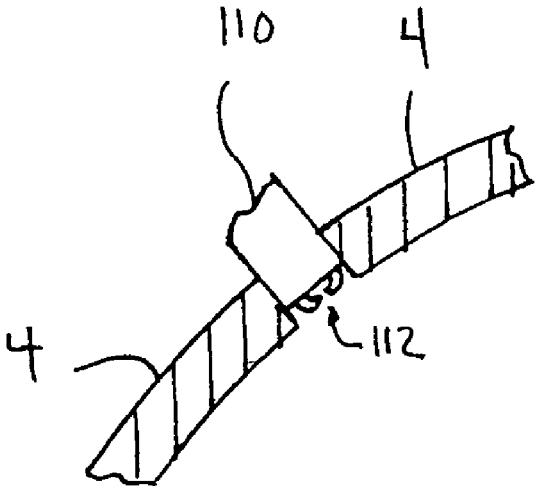
FIG. 9 is a partial view of the sphere of FIG. 7A depicting one example of a spark plug mounted therein.

FIG. 9 is a partial view of the spherical member 4 of FIG. 7A depicting one example of a spark plug 110 mounted therein. The spark plug 110 is shown as having a tip 112 where sparking occurs. In the spherical member 4, there would be two such spark plugs, one for each of the chambers A and B.

Figure 10:
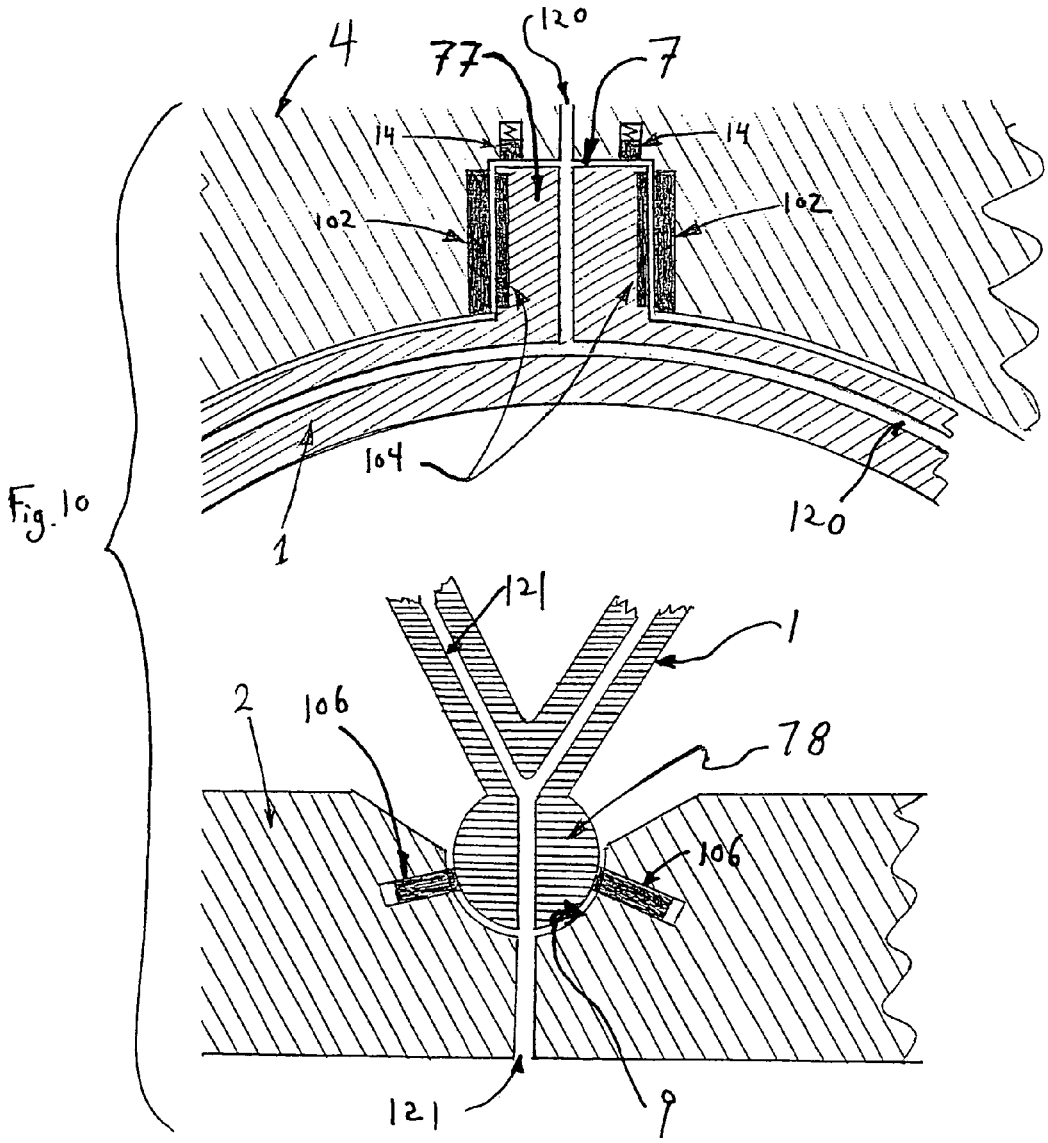
FIG. 10 is a partial sectional view of a bearing arrangement with lubricating channels or passageways usable in the present invention, for providing support for the slideable baffle of FIG. 1.

FIG. 10 is a partial sectional view of one embodiment of a bearing arrangement for the engaging ends of the first baffle member 1. Bearings 102, 102 are schematically indicated on the spherical member 4 in engagement with cooperating bearing members 104, 104 on the ridge 77 of the first baffle member 1. There are also shown a plurality of lubricating passageways 120. In the lower portion of FIG. 10 is shown a partial sectional view of one embodiment of a bearing arrangement for the engaging portions of the first baffle member 1 and the second baffle member 2. Bearings 106, 106 are shown disposed in the second baffle member 2 for engagement with the rounded edge 78 disposed in the groove 9. There are also shown a plurality of lubricating passageways 121. It is contemplated that other bearing and lubricating arrangements may be used, and any such known to one having skill in the engine arts are contemplated as being within the scope of the present invention.

Figure 11:
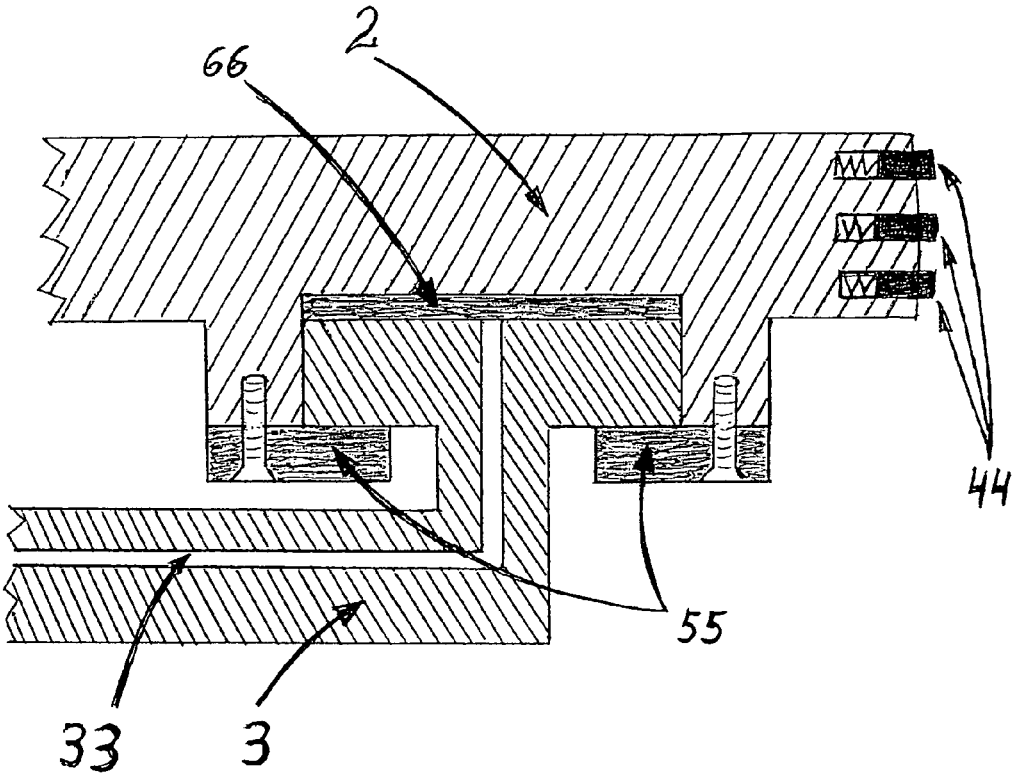
FIG. 11 is a sectional view of an embodiment of a baffle engaged with a rotor of FIG. 1, having schematically indicated compression rings and a lubrication channel.

FIG. 11 is a sectional view of a preferred embodiment of a bearing and lubricating channel arrangement for the engagement between the rotor 3 and the second baffle member 2. As seen in FIG. 11, the baffle 2 carries a plurality of spring forced compression rings 44, and bolted disks 55, 55 serving as composite bearings. The rotor 3 has a lubrication channel 33, and a bearing portion 66 which is preferably an embedded bearing or composite disk bearing. In every rotation, the groove will be splashed by oil. The additional lubrication will inevitably increase oil consumption of the engine. The provision of such lubricant channels is well known in the engine arts, and the manner of providing such lubricant channels would be within the ambit of the routineer in the engine coolant arts. All such variations are contemplated as being within the scope of the present variations are contemplated as being within the scope of the present invention.

The invention being thus described, it will be evident that the same may be varied in many ways. Such variations are not to be regarded as a departure from the spirit and scope of the invention and all such modifications are intended to be included within the scope of the claims.

What is claimed is:

1. A rotary engine, comprising:

a spherical combustion chamber having an internal groove;

a rotor extending into the spherical combustion chamber;

a first baffle having a ridge in engagement with the internal groove; and a second baffle supported by the rotor;

wherein the second baffle has a circular face and a longitudinal groove therein, and the first baffle has one edge in engagement with the longitudinal groove in the second baffle, whereby the first baffle prevents rotation of the second baffle about an axis of the rotor.

2. A rotary engine according to claim 1, wherein the first baffle has a semicircular face.

3. A rotary engine according to claim 1, wherein the first baffle has a semicircular face; and wherein the rotor comprises a rod and a slanted annular face in sliding engagement with the second baffle;

whereby the second baffle oscillates during rotation of the rotor.

4. A rotary engine according to claim 1, wherein the first baffle oscillates in a side to side movement along the groove in the spherical combustion chamber during rotation of the rotor.

5. A rotary engine, comprising:

a spherical combustion chamber;

a rotor extending into the combustion chamber;

a first baffle;

a second baffle;

guiding means for guiding the first baffle in an oscillatory motion with the combustion chamber;

connecting means for connecting the second baffle to the rotor such that rotation of the rotor causes oscillatory movement of the second baffle;

wherein the second baffle has a circular face and a longitudinal groove therein, and the first baffle has one edge in engagement with the longitudinal groove in the second baffle, whereby the first baffle prevents rotation of the second baffle about an axis of the rotor.

6. A rotary engine according to claim 5, wherein the first baffle has a semicircular face.

7. A rotary engine according to claim 5, further comprising a cam sleeve operated by rotation of the rotor.

8. A rotary engine according to claim 5, further comprising a cam sleeve operated by rotation of the rotor, and lifting rods mounted on an external surface of the spherical combustion chamber.

9. A rotary engine, comprising:

a spherical combustion chamber;

a rotor extending into the combustion chamber;

a first baffle;

a second baffle;

guiding means for guiding the first baffle in an oscillatory motion with the combustion chamber;

connecting means for connecting the second baffle to the rotor such that rotation of the rotor causes oscillatory movement of the second baffle; and lifting rods mounted on an external surface of the spherical combustion chamber.

* * * * *